US006463956B2

(12) United States Patent
Walker

(10) Patent No.: US 6,463,956 B2
(45) **Date of Patent: *Oct. 15, 2002**

(54) METHOD OF WATER DISTRIBUTION AND APPARATUS THEREFOR

(75) Inventor: Robert E. Walker, Mercer Island, WA (US)

(73) Assignee: International Water-Guard Industries Inc., Burnaby (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/162,830

(22) Filed: Sep. 29, 1998

(51) Int. Cl.[7] ..... E03B 7/07; F24H 1/00
(52) U.S. Cl. ..... 137/563
(58) Field of Search ..... 137/563, 565.34, 137/883, 565.17; 4/603

(56) References Cited

U.S. PATENT DOCUMENTS 2,786,211 A * 3/1957 Culver, Jr. ..... 4/626
4,969,991 A * 11/1990 Valadez ..... 210/96.2
5,032,290 A * 7/1991 Yamagata et al. ..... 137/563
5,293,654 A * 3/1994 Castwell et al. ..... 4/603
5,303,739 A * 4/1994 Elgoth et al. ..... 137/563
5,309,938 A 5/1994 Ellgoth et al. ..... 137/334
5,351,337 A * 9/1994 Deutsch ..... 137/563
5,622,207 A 4/1997 Frank ..... 137/899.2
5,794,658 A * 8/1998 Saikin ..... 137/563

FOREIGN PATENT DOCUMENTS

EP 0653520 A2 5/1995 ..... E03B/11/00

* cited by examiner

*Primary Examiner*—Charles R. Eloshway
(74) *Attorney, Agent, or Firm*—Moore & Van Allen PLLC; Michael G. Johnston

(57) ABSTRACT

Water is supplied to a water user outlet facility by maintaining a tappable flow of water in a recirculating loop that includes a pump such as a centrifugal pump driven by a substantially constant speed motor to establish the flow, a water delivery path that extends from the pump to the outlet facility, and a water return path that extends from the outlet facility back to the pump. The flow is permitted to be controllably tapped at the facility by a water user while directing any untapped portion of the flow into the water return path. Such recirculation avoids stagnation and thereby impedes deterioration in the potability of the water. Further such recirculation makes the recirculating loop and water within the loop less sensitive to the temperature of the surrounding environment. The recirculating loop may include a water purifier such as an ultra-violet lamp source to kill organic contaminants and, as well, may include a filter to remove inorganic material.

21 Claims, 2 Drawing Sheets

METHOD OF WATER DISTRIBUTION AND APPARATUS THEREFOR

FIELD OF THE INVENTION

This invention relates to water distribution systems, and in particular to water distribution systems that are able to reliably supply and improve the quality of water throughout a range of external environmental conditions.

BACKGROUND TO THE INVENTION

The prior art is replete with water distribution systems of various types. Generally, these are once-through systems where water is delivered from a water tank or other source to a user outlet facility such as a tap, but only when a user demand occurs. The path of water flow may include devices such a filters, water purifiers, or the like that are designed to improve the quality of water passing through.

It is also known in prior art water distribution systems to include a means for recirculating stored water for the purpose of aeration and to prevent stagnation. For example, U.S. Pat. No. 5,351,337 granted to Deutsch on Sep. 27, 1994, discloses a system that may be selectively controlled to deliver water from a storage tank to a user outlet facility along a once-through path or, alternately, to recirculate water in a short loop that bypasses a substantial part of the path to facility.

Such systems fail to take full advantage of the benefits that can be achieved with devices such as air and water filters and water purifiers. Further, such systems typically will be quite sensitive to the temperature of the surrounding environment and incapable of operating in freezing temperatures for extended periods without external heating, for example, as is common with many aircraft water distribution systems.

A primary object of the present invention is to provide a method of water distribution and water distribution apparatus that has reduced sensitivity to the temperature of the surrounding environment and that is capable of being operated at freezing temperatures or below for extended periods of time without the need for external heating.

A further object of the present invention is to provide a method of water distribution and water distribution apparatus that is able to improve the quality or impede the deterioration of water, including substantial reduction of organic and inorganic contamination in the system by way of water and air supplied to the system.

SUMMARY OF THE INVENTION

In a broad aspect of the method of the present invention, water is supplied to a water user outlet facility by maintaining a tappable flow of water in a recirculating loop that includes a pump that establishes the flow, a water delivery path that extends from the pump to the outlet facility, and a water return path that extends from the outlet facility back to the pump. The flow is permitted to be controllably tapped at the facility by a water user while directing any untapped portion of the flow into the water return path.

The system may include only a single water user outlet facility. However, more typically, it is contemplated that it will include a plurality of such facilities located at intervals around the recirculating loop. In such cases, a part of the water return path for all but the last facility in the loop will also be a part of the water delivery path for the one or more other facilities in the loop.

Two immediate advantages derive from such recirculation. Firstly, recirculation avoids stagnation and thereby impedes deterioration in the potability of the water. The formation of bacteriological colonies is deterred. Secondly, recirculation makes the recirculating loop and water within the loop less sensitive to the temperature of the surrounding environment. In this regard, it will be understood that the operation of the pump effectively adds energy to the system and inherently tends to maintain a continuous and uniform thermal level throughout the system. The added energy to a degree serves to balance heat energy loss to the surrounding environment. Thus, where water in a non-recirculating system will eventually freeze if the system is exposed for a sufficient length of time to freezing temperatures, it may be maintained in a liquid condition in the present system even though the water delivery path, the water return path, or parts thereof, may be so exposed for extended periods. Such avoidance of freezing may be achieved without the necessity to provide external heating for either the water delivery or the water return paths. Of course, there are limits depending upon the volume flow rate that can be maintained by the pump. Harsher environments may dictate a pump that is capable of adding more energy than a pump that would suffice for more moderate environments.

To make the system more adaptable to differing water usage rates, the pump is preferably a centrifugal pump that is driven by a substantially constant speed motor configured to provide a relatively constant discharge pressure over a broad range of water flow rates.

Advantageously, the recirculating loop may include a water purifier such as an ultra-violet lamp source to kill organic contaminants and to impart heat into the water, thus assisting in reducing the probability of freezing in harsh environments. The recirculating loop may also include a filter to remove inorganic material. Preferably, all such devices are located within the water delivery path of the loop and upstream from all water user outlet facilities. While such devices are generally well known in and of themselves, their effectiveness is enhanced by the present system because any given control volume of water may pass through the devices many times before it is ultimately tapped by a user.

In one embodiment of the present invention, the recirculating loop includes a water storage tank in which water is stored as a preliminary step. This embodiment is considered particularly suitable for mobile applications, and especially applications such as airborne applications where the system may be exposed to a wide range of environmental temperatures depending upon flight operations. In airborne operations, the system may be operated whether it takes operating power from the aircraft electrical system while in flight or from ground support facilities while on the ground with the aircraft engines shut down. It is noteworthy that since the water storage tank need not be pressurized as typical in conventional aircraft, it may be shaped or configured to take better advantage of available space within the contours of the aircraft hull.

In another embodiment of the present invention a storage tank is not included. Flow is maintained in the recirculating loop by adding make-up water into the loop to replace water tapped at the user facility or facilities. This embodiment is suited for stationary applications where water is drawn from an external source such as a domestic water supply utility.

DETAILED DESCRIPTION OF PREFERRED EMBODIMENTS

Figure 1:
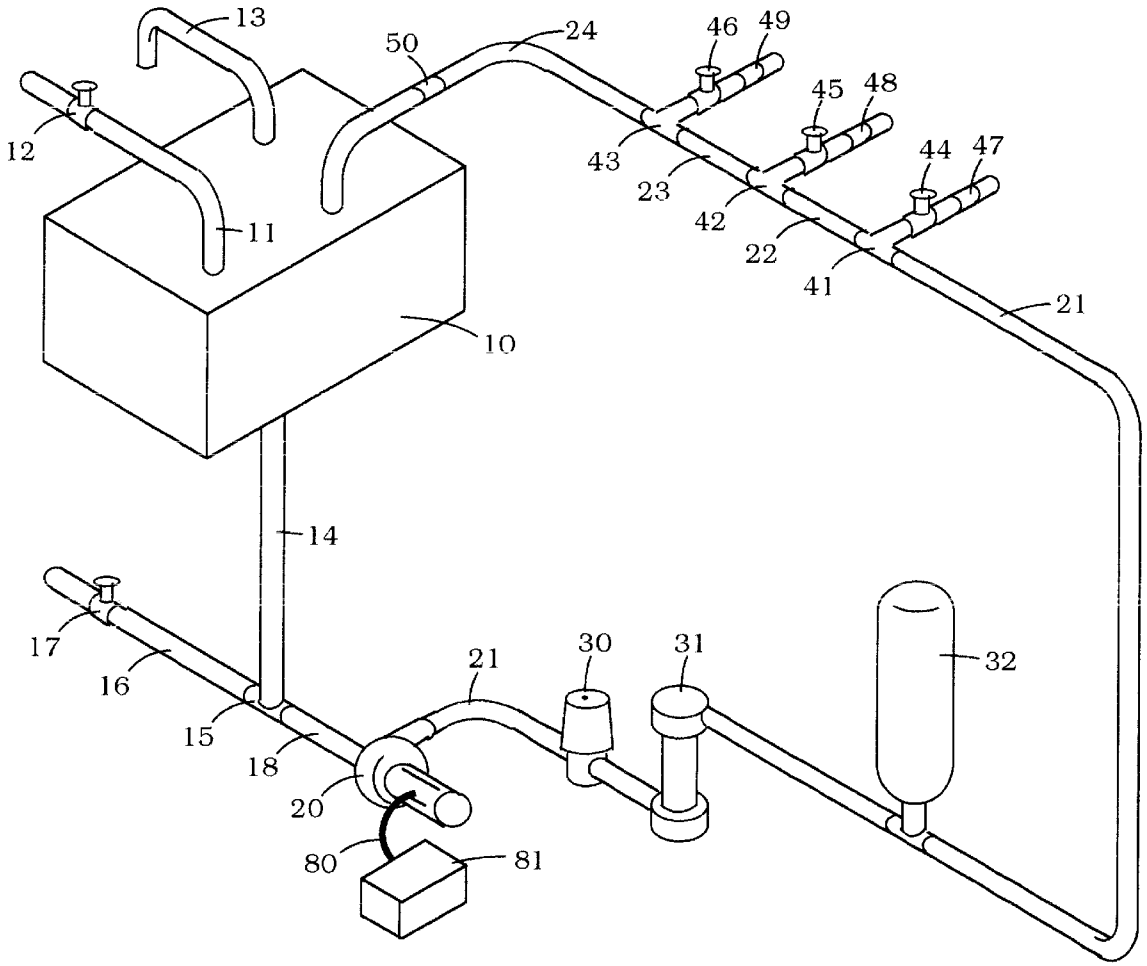
FIG. 1 is a schematic representation of a water distribution system in accordance with the present invention where water for the system is carried in a water storage tank.

The water distribution system shown in FIG. 1 is considered particularly suitable for, but not limited to mobile applications. As shown, the system includes a water storage tank 10 that is initially filled with water through water inlet line 11 from an external source (not shown). The quantity of water received is controlled by a valve 12. Tank 10 also includes an air inlet vent 13 that serves to equalize pressure in the tank with that of the surrounding environment by allowing fresh air from the surrounding environment to enter the tank through a filter (not shown) that forms part of the inlet path.

Stored water is drawn from tank 10 through discharge pipe 14 which leads through a T-connection 15 to a drain pipe 16 and a delivery pipe 18, the latter of which feeds water pump 20. Pipe 16 includes a valve 17 that is normally closed to prevent drainage, but which may be opened if it is desired to empty tank 10.

With reference to pump 20, it will be readily apparent to those skilled in the art that various suitable pumps may be used and that the particular pump for any given case will depend upon the demands of the particular application. However, for reasons noted above, the preferred pump is a centrifugal pump that is operated continuously by a substantially constant speed motor, and that is configured to provide a relatively constant discharge pressure over a broad range of water flow rates. By way of example, one such pump is the Model No. 2242 centrifugal pump available from Howden Fluid Systems of Santa Barbara, Calif. This pump has a rating of 3.5 gallons per minute at 35 psid and includes a substantially constant speed electric motor that operates on 115 VAC, 3 phase, at 400 HZ. Such electrical specifications make the pump compatible with and able to draw operating power from the on-board electrical system of many conventional aircraft.

In the Figures, pump 20 is schematically depicted as being connected by an electrical cable 80 to an electrical power source 81. For airborne applications, source 81 may be considered as representative of the on-board electrical system of an aircraft.

Of course, it will be understood by those skilled in the art that a suitable pump could be driven by other power sources such as compressed gases or fluids, or internal or external combustion engines.

Pump 20 discharges into a water distribution pipe 21 that leads firstly to a water filter 30 that serves to remove inorganic material, then to a water purifier 31 such as a lamp source that irradiates flowing water with ultraviolet radiation to kill organic contaminants, then to an accumulator 32, then to the first of three water user outlet facilities 41, 42, 43 that are interconnected in succession by pipe segments 22, 23. Each outlet facility includes an associated tap valve 44, 45, 46 controllable by water users, and an associated non-return valve (check valve) 47, 48, 49. A water return pipe 24 leads from the last of the three outlet facilities 43 back to tank 10.

Return pipe 24 is shown as including an orifice 50. Orifices are well known elements, the purpose being to maintain system pressure and provide a desired pressure drop. In the case of water returning to tank 10, it is contemplated that in many cases pipe 24 itself may be sized to provide a sufficient pressure drop but, if not, then an orifice such as orifice 50 may be used. The actual need for an orifice will depend upon overall system design and design principles well known to those skilled in the art.

By definition, pipe 21 and the appliances (viz. filter 30, conditioner 31 and accumulator 32) connected along the line of pipe 21 define a water distribution path from pump 20 to the first of the three outlet facilities 41. This path, combined with the path through outlet facility 41 and pipe segment 22 defines a water distribution path from pump 20 to outlet facility 42. Likewise, the foregoing combined path further combined with the path through outlet facility 42 and pipe segment 23 defines a water distribution path from pump 20 to outlet facility 43.

Similarly, each outlet facility has a defined water return path extending from the facility to pump 20. In the case of outlet facility 41, the return path comprises pipe segment 22, outlet facility 42, pipe segment 23, outlet facility 43, return pipe 24 (with or without an orifice 50), tank 10, discharge pipe 14 and delivery pipe 18. Return paths for the remaining two outlet facilities may be similarly defined.

In operation tank 10 is first filled with water. Then, with valve 17 closed, pump 20 drawing power from source 81 is operated to establish and maintain a continuous flow of water in the recirculating loop defined by the water delivery and water return paths described above. While the flow continues, water is delivered from pump 20 to each outlet facility 41, 42, 43 along an associated water delivery path. Concurrently, water may be independently tapped by users at any one or more of the facilities by using tap valves 44, 45 46. At any given facility, water that is not tapped is directed into a water return path associated with the facility. When one or more of the tap valves is controlled to an open or a partially open position, associated check valves 47, 48, 49 will serve to prevent system contamination by external or reverse water or air flow into the recirculating loop through the tap valves.

Typically, the demand at any given outlet will be random in character. But, from time-to-time peak flow conditions may arise. If such conditions are of relatively short duration, then the water flow capacity of pump 20 will be augmented by accumulator 32 without any significant loss of pressure at the outlet facilities. The alternative would be to use a higher rated pump, but it may be considered undesirable to carry a larger pump that is rarely called upon to deliver peak capacity.

From FIG. 1 and the foregoing description, it will be apparent that the bulk of water within the system will have little opportunity to stagnate so long as pump 20 is maintained in operation. Further, the potability of the water is improved as it repeatedly passes through filter 30 and purifier 31. Moreover, as the operation of the system introduces heat energy to the water, the system may be operated in environments where stagnant water might otherwise freeze.

Figure 2:
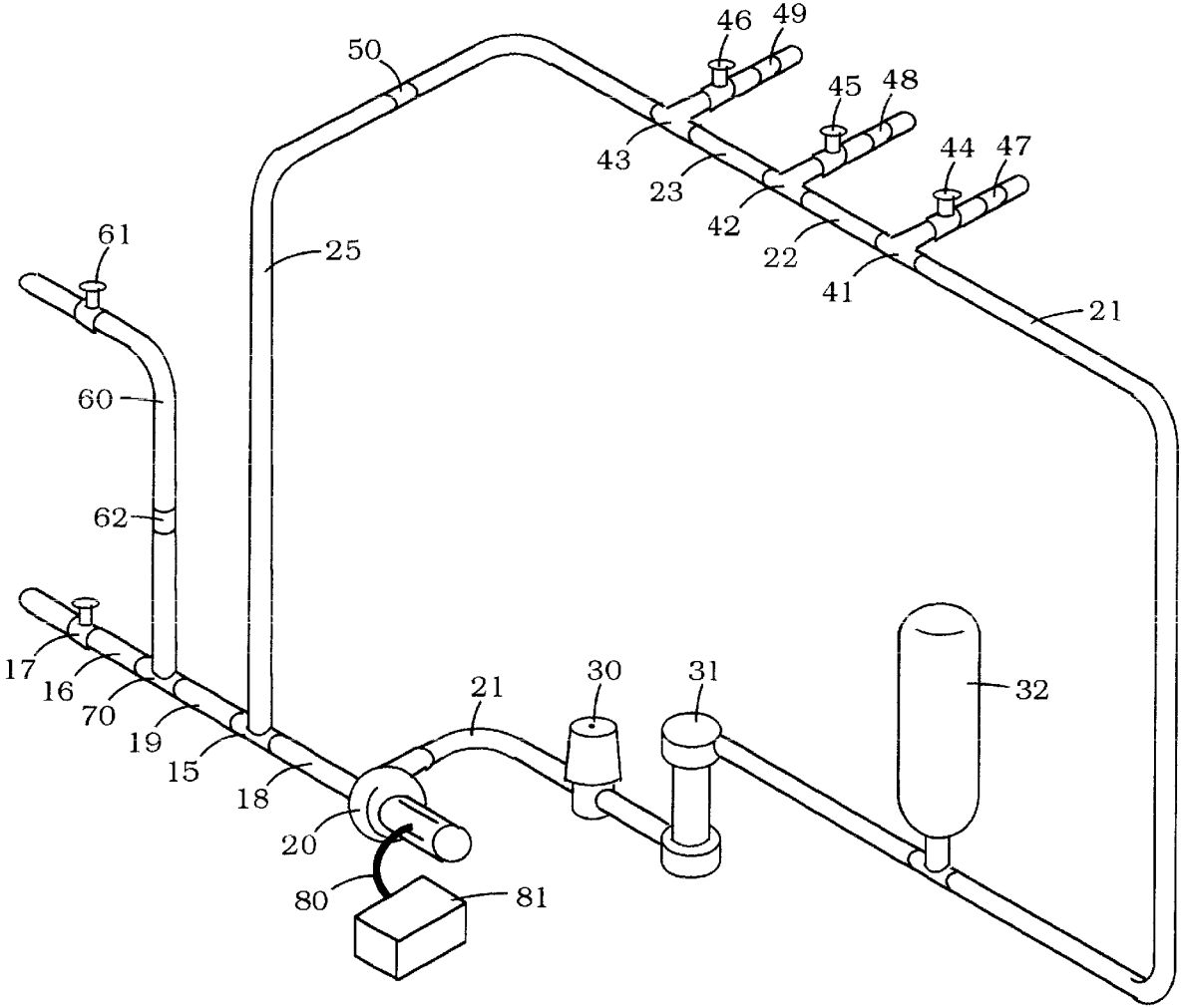
FIG. 2 is a schematic representation of a water distribution system in accordance with the present invention where water for the system is received as make-up water from an external source.

The water distribution system shown in FIG. 2 is very similar to the system shown in FIG. 1, the essential difference being that there is no stored water in the system. Instead, make-up water is added to the recirculating loop described above.

More particularly, there is no storage tank 10 as in the case of FIG. 1. In the system of FIG. 2, a water return pipe 25 extends in place of return pipe 24, storage tank 10, and drain pipe 14 of FIG. 1. Make-up water is delivered to the system through inlet pipe 60, T-connection 70 and pipe section 19, and is added to the recirculating loop at at a water supply junction provided by T-connection 15. Pipe 60 is connected to an external source of water (not shown) and includes a valve 61 to control the quantity of water supplied. Further, pipe 60 includes a check valve 62 to prevent back flow.

When the system of FIG. 2 is in operation, water cycles in the recirculating loop in essentially the same manner as the system of FIG. 1. The basic difference is that new water will be added to the loop at T-connection 15 to make-up for any water that is drained at outlet facility 44, 45 or 46. Generally, the same advantages as may be realized with the system of FIG. 1 may also be realized with the system of FIG. 2.

Various modifications and changes to the embodiments that have been described can be made without departing from the scope of the present invention, and will undoubtedly occur to those skilled in the art. The invention is not to be construed as limited to the particular embodiments that have been described and should be understood as encompassing all those embodiments that are within the spirit and scope of the claims that follow.

I claim:

1. A method of supplying water to a water user outlet facility while improving or impeding deterioration in the potability of such water, said method comprising:

(a) directing a tappable flow of water in a water recirculation loop, said loop comprising:

(i) a non-pressurized water tank;

(ii) a water pump for establishing and maintaining said flow while imparting thermal energy to water within said loop, said pump being configured to provide a relatively constant discharge pressure over a broad range of water usage rates;

(iii) a water delivery path extending from said pump to said outlet facility;

(iv) a water return path extending from said facility to said pump; and, (v) at least one water treatment device for improving the potability of water within said loop, (b) operating said pump at a water flow rate which is sufficient to warm the water to the extent necessay to avoid the freezing of water within said loop while any one or more parts of said loop is exposed for an extended period of time to an ambient temperature substantially below the freezing temperature of water; and, (c) controllably tapping a portion of said flow through said outlet facility from a water inlet port in water flow communication with said loop to a water discharge port while directing any untapped portion of said flow into said water return path.

2. A method as described in claim 1 further comprising the preliminary step of storing a quantity of water in said tank.

3. A method as described in claim 2, wherein said water storage tank is positioned between said outlet facility and said pump as a part of said water return path.

4. A method as described in claim 2, wherein said recirculation loop is part of a water supply system carried on board a vehicle.

5. A method as described in claim 4, wherein said vehicle is an aircraft.

6. A method as described in claim 1, further including adding make-up water into said loop to replace water in said loop as tapping occurs through said outlet facility.

7. A method as described in claim 4, wherein said make-up water is added into said loop at a water supply junction between said outlet facility and said pump in said water return path.

8. A method as described in claim 1 wherein said at least one water treatment device comprises a water purifier for irradiating water flowing in said water delivery path with ultra-violet radiation to kill organic contaminants.

9. A method as described in claim 1 wherein said at least one water treatment device comprises a water filter for filtering water flowing in said water delivery path to remove inorganic material.

10. A method as described in claim 1, wherein said at least one water treatment device comprises:

(a) a water purifier for irradiating water flowing in said water delivery path with ultra-violet radiation to kill organic contaminants; and, (b) a water filter for filtering water flowing in said water delivery path to remove inorganic material.

11. Water distribution apparatus, comprising:

(a) a water user outlet facility;

(b) a water recirculation loop, said loop comprising:

(i) a non-pressurized water storage tank;

(ii) a water pump for establishing and maintaining a flow of water in said loop while imparting thermal energy thereto, said pump being configured to provide a relatively constant discharge pressure over a broad range of water usage rates:

(iii) a water delivery path extending from said pump to said outlet facility;

(iv) a water return path extending from said facility to said pump; and, (v) at least one water treatment device for improving the potability of the water within said loop, and, (c) a power source operatively connected to said pump, said pump water flow generating a predetermined rate which is sufficient to avoid the freezing of water within said loop while any one or more parts of said loop is exposed for an extended period of time to an ambient temperature substantially below the freezing temperature of water; said outlet facility including:

(i) a water inlet port in water flow communication with said water delivery path;

(ii) a water outlet path extending from said water inlet port to a water outlet port; and, (iii) a tap valve disposed in said water outlet path and controllable by a water user to tap a portion of said flow from said water delivery path through said water outlet path while said outlet facility directs a remaining portion of said flow into said water return path.

12. Water distribution apparatus as described in claim 11, said outlet facility further including a check valve to prevent contamination of water flowing within said recirculation loop by external water or air flowing into said recirculation loop through said tap valve.

13. Water distribution apparatus as described in claim 11, wherein said tank is positioned between said outlet facility and said pump as a part of said water return path.

14. Water distribution apparatus as described in claim 11, wherein said tank includes an air inlet vent for permitted air to enter said tank from a surrounding environment.

15. Water distribution apparatus as described in claim 12, further including a water supply junction between said outlet facility and said pump for adding make-up water into said loop to replace water in said loop as tapping occurs through said outlet facility. inlet vent for permitting air to enter said tank from a surrounding environment.

16. Water distribution apparatus as described in claim 11, further including a water supply junction between said outlet facility and said pump for adding make-up water into said loop.

17. Water distribution apparatus as described in claim 11, further including a water purifier for irradiating water flowing in said loop with ultra-violet radiation to kill organic contaminants.

18. Water distribution apparatus as described in claim 11, further including a filter for removing inorganic material from water flowing in said loop.

19. Water distribution apparatus as described in claim 11, further including:

(a) a water purifier for irradiating water flowing in said loop with ultra-violet radiation to kill organic contaminants; and, (b) a filter for removing inorganic material from water flowing in said loop.

20. Water distribution apparatus as described in claim 19, wherein:

(a) said recirculation loop further includes a water storage tank; and, (b) said tank includes an air inlet vent for permitting air to enter said tank from a surrounding environment.

21. Water distribution apparatus as described in claim 1 installed for operation on board an aircraft, said pump being a centrifugal pump driven by an electric motor and connected to an on-board power source of said aircraft for drawing operating power from said on-board source.

* * * * *

UNITED STATES PATENT AND TRADEMARK OFFICE

CERTIFICATE OF CORRECTION

PATENT NO. : 6,463,956 B2
DATED : October 15, 2002
INVENTOR(S) : Robert E. Walker It is certified that error appears in the above-identified patent and that said Letters Patent is hereby corrected as shown below:

Column 5,
Line 62, change “4” to -- 6 --.

Column 6,
Line 31, change “said pump water flow generating a predetermined rate” to -- said pump generating a predetermined water flow rate --.
Lines 62 and 63, delete “inlet vent for permitting air to enter said tank from a surrounding environment.”

Column 8,
Line 8, change “1” to -- 12 --.

Signed and Sealed this

First Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,463,956 B2
DATED : October 15, 2002
INVENTOR(S) : Robert E. Walker It is certified that error appears in the above-identified patent and that said Letters Patent is hereby corrected as shown below:

Column 6,
Line 56, change “permitted” to -- permitting --.
Line 58, cancel beginning with “15. Water distribution apparatus” to and including “said outlet facility.” in line 62.
Line 64, change “16” to -- 15 --.

Column 7,
Line 1, change “17” to -- 16 --.
Line 5, change “18” to -- 17 --.
Line 8, change “19” to -- 18 --.

Column 8,
Line 1, change “20” to -- 19 --.
Line 8, change “21” to -- 20 --.

Signed and Sealed this

Twenty-seventh Day of April, 2004

JON W. DUDAS
*Acting Director of the United States Patent and Trademark Office*